US005887987A

United States Patent [19]

Sawano

[11] Patent Number: 5,887,987

[45] Date of Patent: Mar. 30, 1999

[54] IMAGE RECORDING DEVICE

[75] Inventor: Ichiro Sawano, Osaka, Japan

[73] Assignee: Minolta Co., Ltd., Osaka, Japan

[21] Appl. No.: 57,483

[22] Filed: Apr. 9, 1998

[30] Foreign Application Priority Data

Apr. 17, 1997 [JP] Japan ..... 9-099853
May 19, 1997 [JP] Japan ..... 9-128620

[51] Int. Cl.[6] ..... B41J 11/20

[52] U.S. Cl. ..... 400/56; 400/55; 347/8

[58] Field of Search ..... 400/56, 55, 28, 400/58, 59; 347/8, 16, 104

[56] References Cited

U.S. PATENT DOCUMENTS

| | | | |
|---|---|---|---|
| 5,156,467 | 10/1992 | Kitahara | 400/58 |
| 5,257,867 | 11/1993 | Ito et al. | 400/59 |
| 5,358,230 | 10/1994 | Ikemori et al. | 347/104 |
| 5,370,380 | 12/1994 | Suzuki et al. | 347/104 |
| 5,648,808 | 7/1997 | Yanagi et al. | 347/104 |
| 5,725,319 | 3/1998 | Saito et al. | 347/104 |
| 5,751,304 | 5/1998 | Saikawa et al. | 347/8 |

FOREIGN PATENT DOCUMENTS

| | | | |
|---|---|---|---|
| 404347678 | 12/1992 | Japan | 347/8 |
| 7-52483 | 2/1995 | Japan . | |
| 7-156472 | 6/1995 | Japan . | |
| 7-206173 | 8/1995 | Japan . | |
| 8-2059 | 1/1996 | Japan . | |
| 8-25750 | 1/1996 | Japan . | |
| 8-58184 | 3/1996 | Japan . | |
| 8-72359 | 3/1996 | Japan . | |
| 8-80609 | 3/1996 | Japan . | |
| 8-118761 | 5/1996 | Japan . | |

*Primary Examiner*—Edgar Burr
*Assistant Examiner*—Anthony H. Nguyen
*Attorney, Agent, or Firm*—Burns, Doane, Swecker & Mathis, LLP

[57] ABSTRACT

An image recording device being capable of setting a separating pawl and a print head at an appropriate location by a position changeover operation at one point according to types of recording sheets. The device comprises a sheet feeder having the separating pawl which is switched over to an effecting position or non-effecting position according to types of recording sheets, and a recording section having a print head for recording images onto the recording sheets passed through between a platen and the print head. The distance between the print head and the platen can be changed over, and linking to this changeover operation, the positions of the separating pawl is switched over.

8 Claims, 16 Drawing Sheets

Fig. 14A
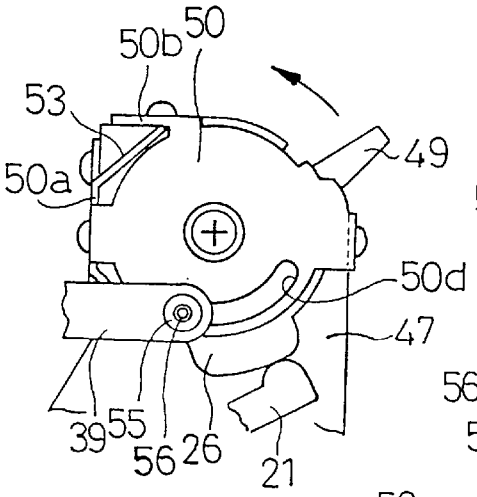
Fig. 14C Fig. 14D
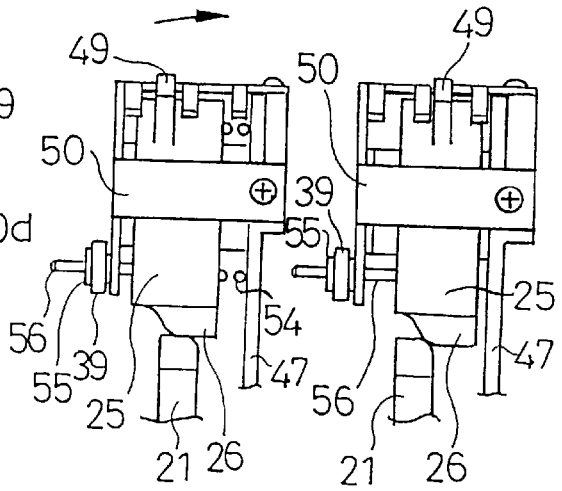
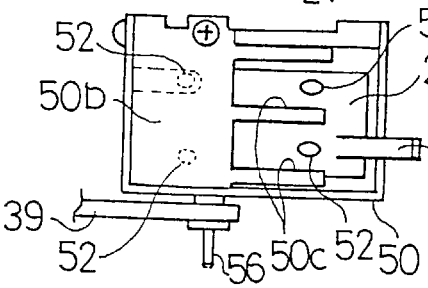
Fig. 14B
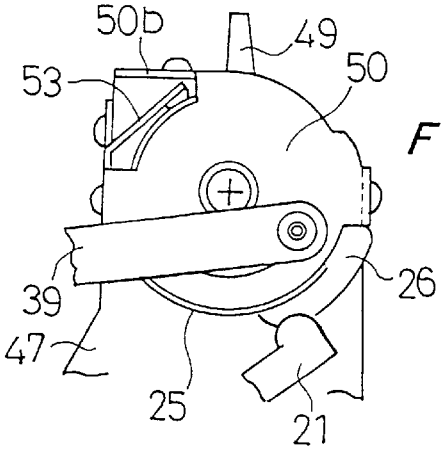
Fig. 14E

IMAGE RECORDING DEVICE

BACKGROUND OF THE INVENTION

1. Technical Field of the Invention

This application is based on applications Nos. 9-099853 and 9-128620 filed in Japan, the contents of which is hereby incorporated by reference.

The present invention relates to an image recording device, and particularly to an image recording device of such type as to record images by ejecting ink or toner from a print head onto a sheet or by directing a light beam in accordance with image data while the sheet is transferred in a direction crossing at right angles with the recording direction, and further to a sheet feeding mechanism incorporated in such an image recording device.

2. Description of Related Art

A conventional sheet feeder incorporated in an image recording device as mentioned above is usually provided with a separating pawl disposed and contacted at both sides of a leading edge of the sheets for effecting reliable separation of recording sheets sent out by feeding rollers.

It is also a known art to provide a pawl position changeover mechanism with which the separating pawl is retreated to a non-effecting position for preventing the pawl from being an obstruction to the feeding of thick or hard sheets. An operative lever of such pawl position changeover mechanism is normally disposed on the side of a sheet feeder tray.

Also, in order to record high-quality images, it is necessary to maintain a prescribed distance between a print head and the recording sheet. It is thus required to change over the distance between the print head and a platen in accordance with the thickness of the recording sheets, and it has been proposed to provide a head position changeover mechanism for switching over the position of the print head. An operative lever of this head position changeover mechanism is normally provided on a carriage on which the print head is mounted, or disposed on a supporting member of a guide shaft of the carriage.

For conveying various types of recording sheets, it is necessary to change the positions of the separating pawl and the print head depending on the thickness or resiliency of the sheets. Operation of two different operative levers is thus required for the changeover. Moreover, the operative lever of the head position changeover mechanism is disposed within the cover of the main device body, making the switchover operation highly troublesome. When the changeover operation is forgotten, the sheets are supplied in an inappropriate setting condition, thus inducing feeding errors or recording errors wherein the recording sheets are stained by contacting the print head.

Also, for an image recording device described above, it is recommended to use special type of paper for achieving image forming of highly fine quality. Such special paper is generally covered with a coating in which a multiplicity of minute pores are formed, through which the ink deposited on the surface of the paper is led under the coating.

However, when a roller or the like is tightly pressed on the coating, the pores in a portion that is pressed are destroyed thus being disabled to lead the ink under the coating. Also, the ink deposited in the portion that is pressed by the roller may splatter, causing printing errors. As a result, the quality of printed images sometimes varies between the parts pressed by the roller and those that are not.

Also, when the roller contacts with a portion where the ink has been deposited on the sheet which has been passed through a printing section, the ink that is not fully dried may attach to the roller, which may be offset to a next sheet. Therefore, in the discharging section of a printer or the like, a star wheel is provided instead of the roller for conveying sheets. However, star wheels have a very small contacting area with the sheets thus being incapable of supplying a sufficient amount of conveying force to the sheets. The sheet feeding mechanism incorporated in conventional image recording devices have such problems as described above that images may be damaged or the sheets cannot be conveyed with a sufficient amount of force.

BRIEF SUMMARY OF THE INVENTION

In view of the foregoing, it is an object of the present invention to provide an image recording device which is capable of solving the above described various problems in prior arts.

In order to accomplish the above said object, the image recording device according to one aspect of the present invention comprises a sheet feeding mechanism for supplying recording sheets, having a separating pawl for separating the recording sheets which is movable between an effecting position and non-effecting position; a platen for guiding the recording sheets supplied by the sheet feeding mechanism; a print head disposed opposite to the platen for recording an image onto the recording sheets guided by the platen, the print head and the platen being spaced such as to have a first distance and a second distance being different from the first distance that can be changed over to one another; and a linking mechanism for causing an action of changing over positions of the separating pawl to link with an action of changing over the distance between the print head and the platen.

In this way, the position of the separating pawl and the distance between the print head and the platen are appropriately set according to the type of sheets by operating the operative member at only one point through the linking mechanism, whereby the changeover operation will be simplified, as well as feeding errors or defective image recording can be prevented which may be caused by forgetting the changeover.

In order to accomplish the above said object, a sheet feeding device according to another aspect of the present invention comprises: a guide plate for guiding a side edge of sheets, said guide plate being able to move in a widthwise direction of the sheets in accordance with a width of the sheets; and a first rotating member for conveying the sheets guided by the guide plate, said first rotating member being able to move in the widthwise direction of the sheets, said movement of the first rotating member being linked to the movement of the guide plate.

In this way, the rotating member for feeding sheets can be moved away to an appropriate position in accordance with the size of the sheets only by moving the guide plate, linked with which the rotating member is movable. For example, it is thereby possible to retreat the rotating member to the outside of a printing area depending on the size of paper, whereby damages to images will be prevented and the sheets can be conveyed with a sufficient amount of force.

Other and further objects, features and advantages of the invention will appear more fully from the following description.

BRIEF DESCRIPTION OF THE DRAWINGS

FIGS. 7A–7C show a construction and actions of a head position changeover mechanism in the embodiment, in which FIG. 7A is a front view of a state located at the first position, FIG. 7B is a cross sectional view taken along the line A—A of FIG. 7A, and FIG. 7C is a front view of a state located at the second position;

FIGS. 14A–14E show a position changeover mechanism in an image recording device according to a third embodiment of the present invention, wherein FIG. 14A is a front view, FIG. 14B is a plan view of FIG. 14A, FIG. 14C is a side elevation view, FIG. 14D is a side elevation view in which the rotating member is located at its second position along the axial direction, and FIG. 14E is a front view in which the rotating member is at its second rotated position as well as at its second position along the axial direction;

DETAILED DESCRIPTION OF PREFERRED EMBODIMENTS

Preferred embodiments of the present invention will be hereinafter described in the form of an inkjet printer referring to FIG. 1 to FIG. 9.

Figure 1:
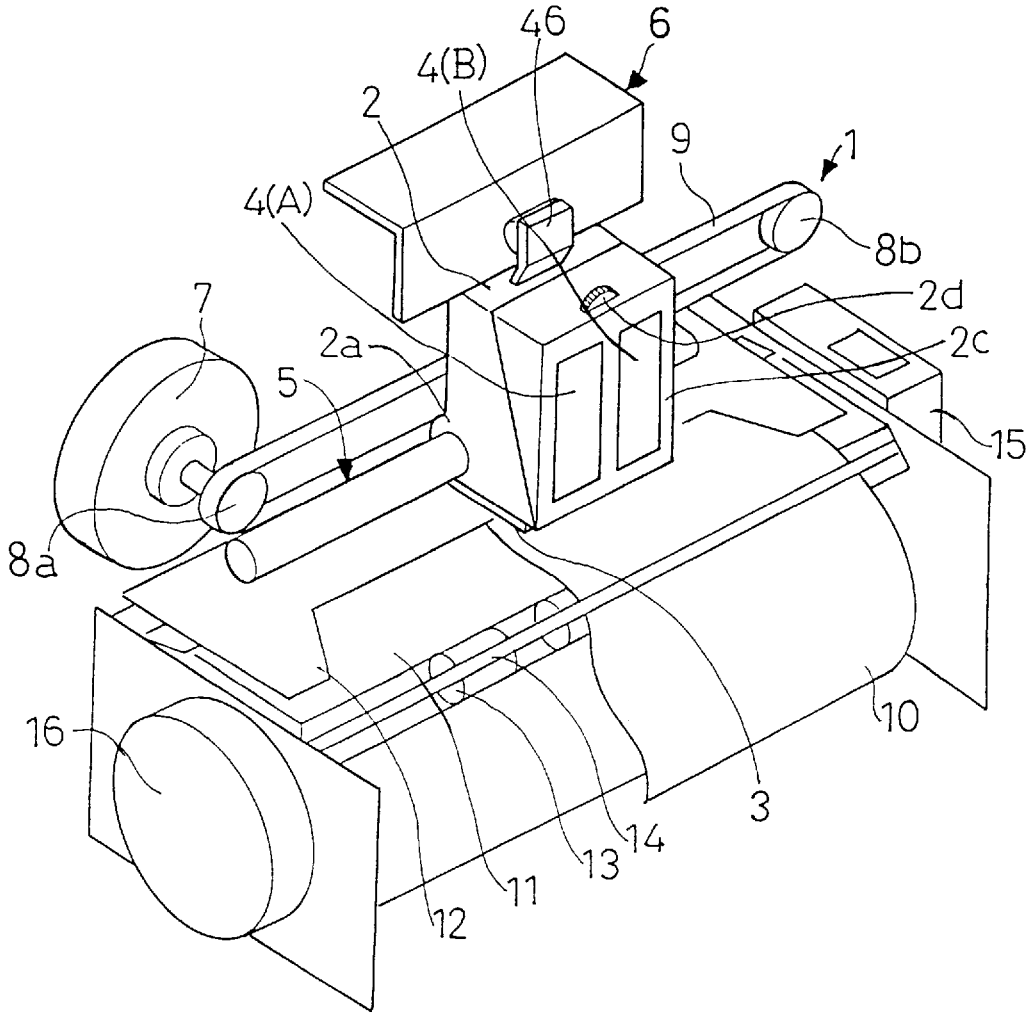
FIG. 1 is a perspective view showing an arrangement of primary parts in an image recording device according to an embodiment of the present invention.

In FIG. 1 which illustrates the schematic construction of main parts of an inkjet printer 1, a reference numeral 2 denotes a carriage on which a print head 3 is mounted, and a plurality of ink tanks 4 (A,B) which supply ink of predetermined colors to the print head 3 are removably mounted on the print head 3. The carriage 2 is constructed such that its open/close cover 2*c* on the front face is opened by operating an open/close tab 2*d* for mounting or dismounting of the ink tanks 4. The carriage 2 is supported with a lower guide 5 and an upper guide 6 such that it can travel sideways along a prescribed movement path which is parallel to the widthwise direction of a recording sheet 10, and driven to reciprocate by a drive motor 7 through a drive pulley 8*a,* an idle pulley 8*b,* and a timing belt 9.

The lower guide 5 supports the carriage 2 such as to allow it to move only along the direction of its movement path, while the upper guide 6 supports the carriage 2 such that it can move both along the direction of movement path and along the vertical direction.

A reference numeral 11 denotes a platen which is disposed exactly below the print head 3, with which the platen 11 constitutes the recording section in which images are recorded on the recording sheet 10 that is passed through between them. The platen 11 also serves as a guide plate for guiding the recording sheet 10 toward the recording section. A sheet holding plate 12 is provided at the upper side of the recording section with respect to the feeding direction of the recording sheet 10 for preventing the recording sheet 10 from rising from the platen 11. Also provided are a discharge roller 13 and a spur roller 14 at the lower side of the recording section with respect to the feeding direction of the recording sheet 10 for discharging the recording sheet, a recovery system 15 which prevents malfunction of ink ejection by cleaning the surface of the print head 3 where the ink is ejected, and a sheet feeding knob 16 for manually transferring the recording sheet 10.

When recording an image, the carriage 2 is driven by the drive motor 7, drive pulley 8*a,* idle pulley 8*b,* and the timing belt 9 for main scanning in the widthwise direction of the recording sheet 10, in which one or a few lines of the image is recorded by the print head 3 mounted to the carriage 2. Each time the recording of one main scanning is completed, the recording sheet 10 is conveyed in the lengthwise direction for secondary scanning. An image is thus recorded on the sheet 10 which is then discharged by the discharge roller 13 and the spur roller 14 pressed against it after passing through the recording section.

Figure 2:
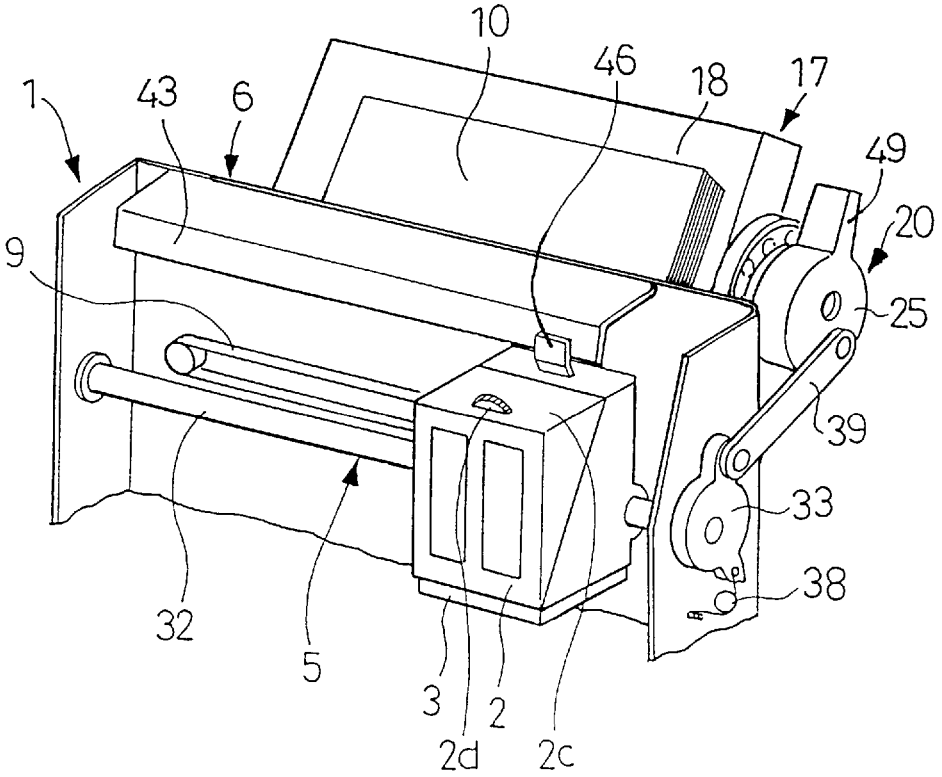
FIG. 2 is a perspective view showing a schematic construction of primary parts in the embodiment.

FIG. 2 shows a sheet feeder 17 which supplies recording sheets 10 piled on a feeder tray 18 one by one toward a sheet feeding path between the platen 11 and the sheet holding plate 12. Provided on one side of the sheet feeder 17 is a separating pawl 21 (see FIG. 3) which is switched from the effecting position to the non-effecting position, and vice versa, as well as the position changeover mechanism 20 for changing the distance between the print head 3 and the platen 11 by switching over the position of the lower guide 5.

Figure 3:
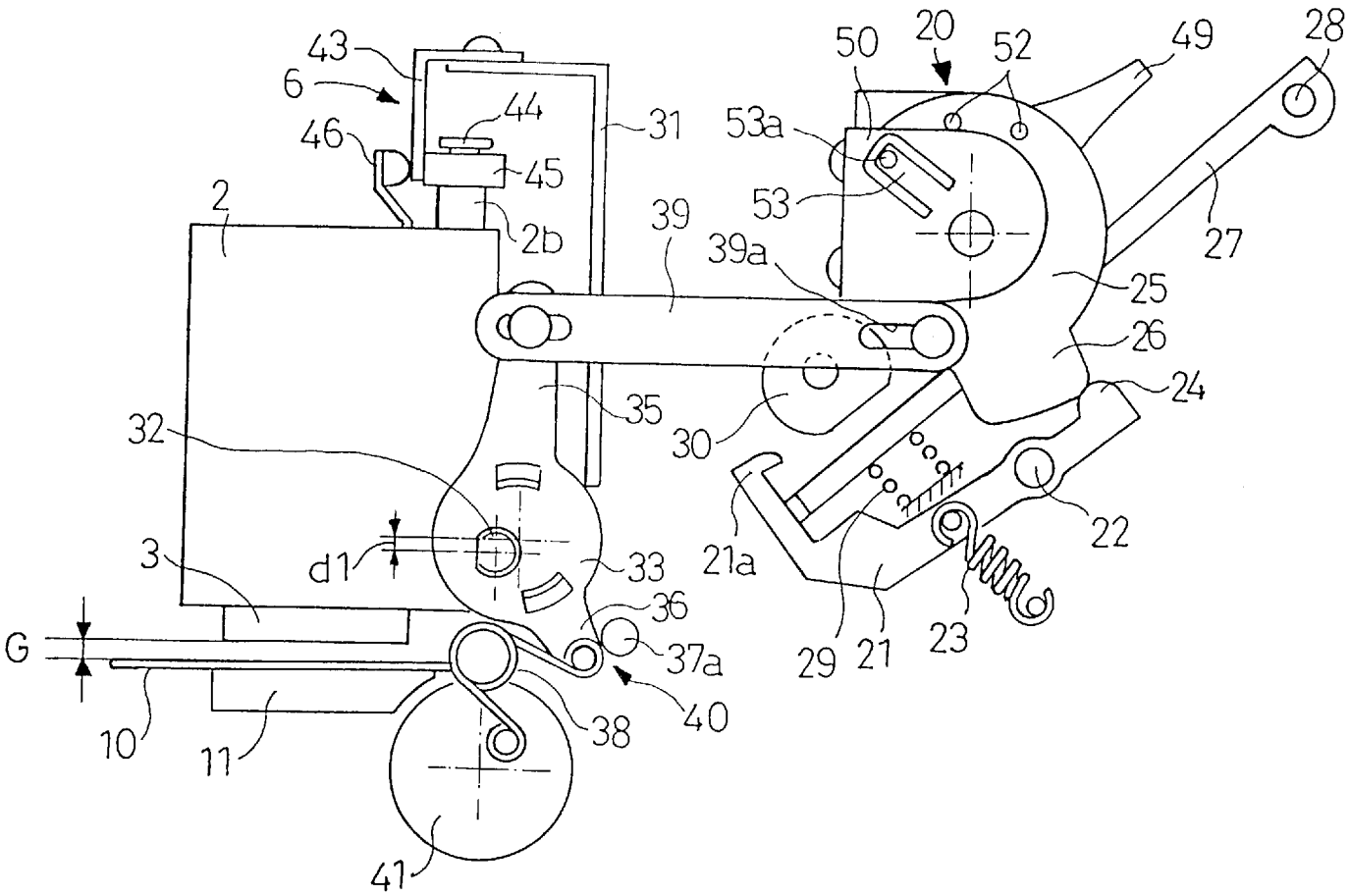
FIG. 3 is a front view showing an arrangement of primary parts in a state located at a first position in the embodiment.
Figure 4:
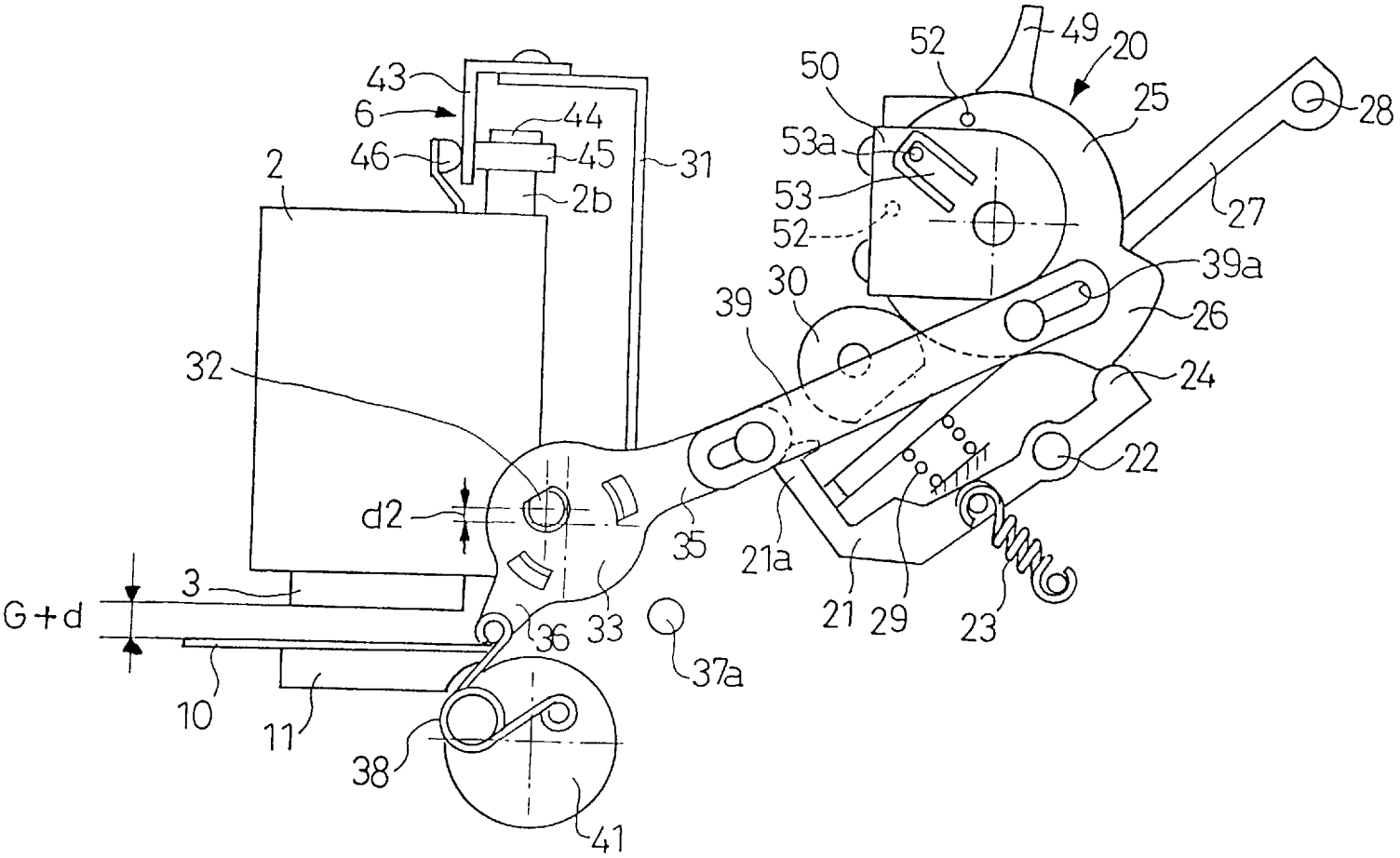
FIG. 4 is a front view showing an arrangement of primary parts in a state located at a second position in the embodiment.
Figure 5:
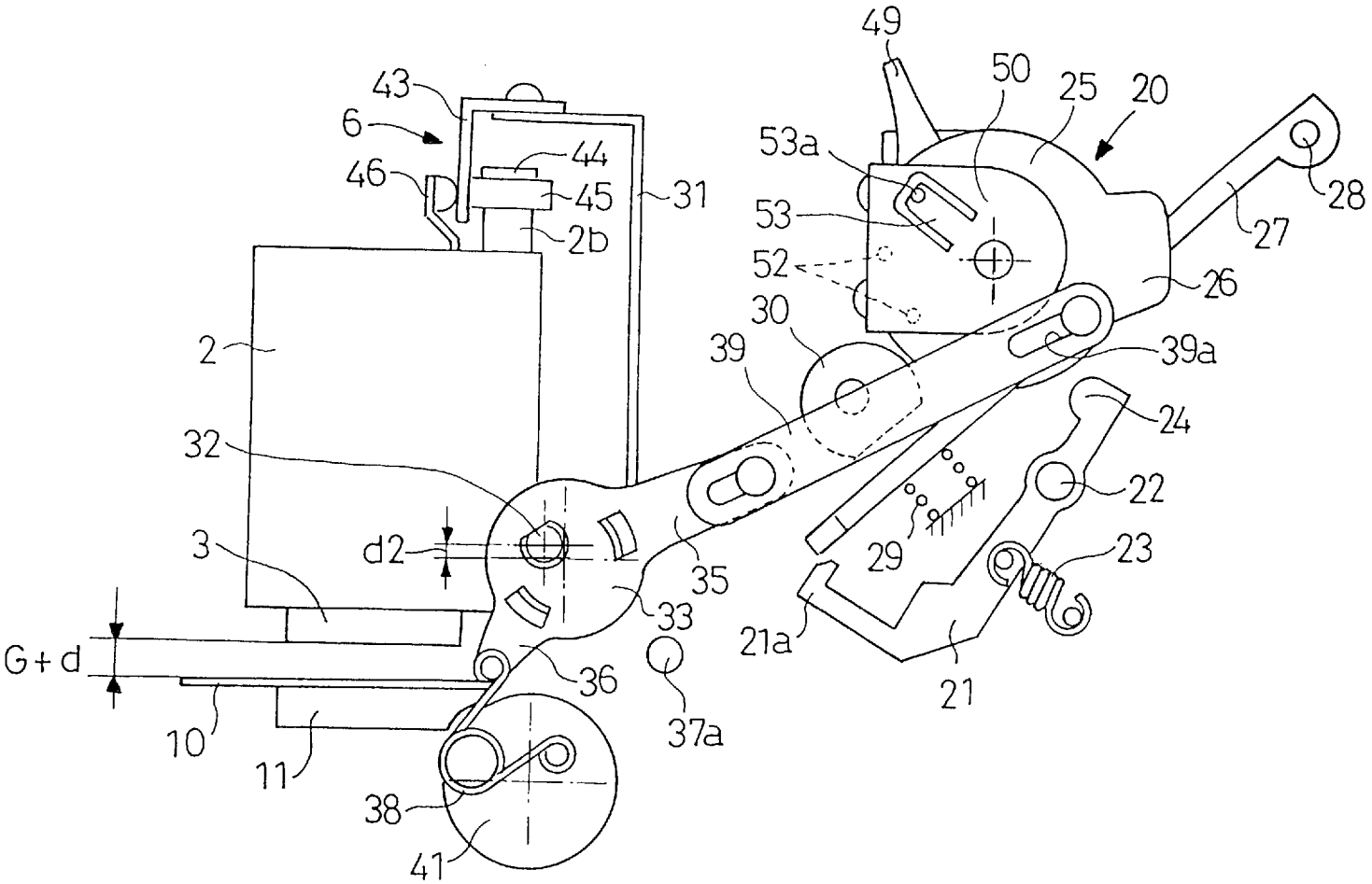
FIG. 5 is a front view showing an arrangement of primary parts in a state located at a third position in the embodiment.
Figure 6A:
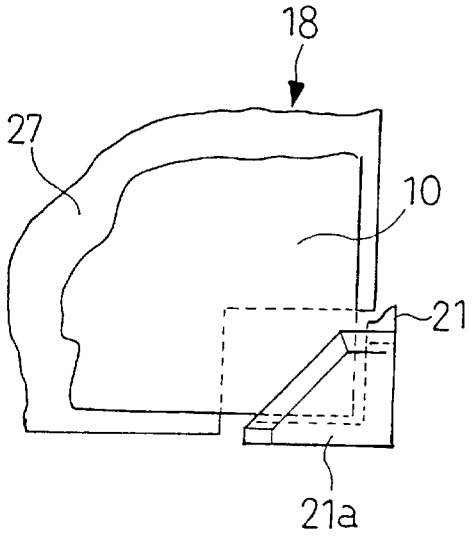
FIG. 6A is a plan view and FIG. 6B is a perspective view, both showing an arrangement of disposition of the separating pawl in the embodiment.
Figure 6B:
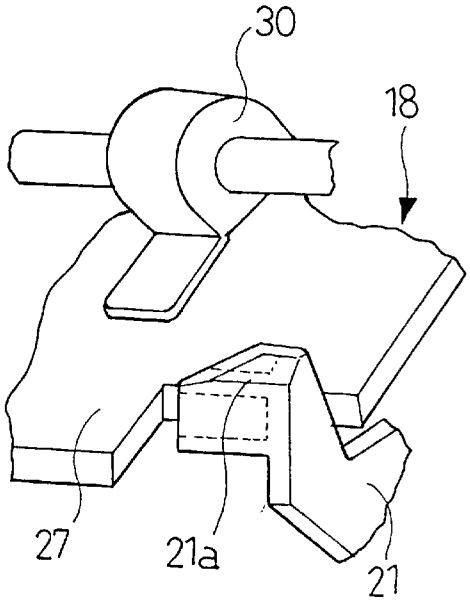

The construction of a changeover linking mechanism for switching over the separating pawl 21 and the position of the lower guide 5 by operating the position changeover mechanism 20 is shown in FIG. 3 to FIG. 5. The separating pawl 21 has a catch 21*a* at its one end as shown in FIG. 6 for coupling with the side edge portion at the leading end of the recording sheet 10 on the feeder tray 18. This separating pawl 21 is swingably supported around a shaft 22 at its middle part, and biased downwards to the non-effecting position with a tension spring 23. Also provided is a boss 24 at the upper edge of the other end of the separating pawl 21 which is coupled to a cam 26 which is disposed at a given location on the periphery of a rotating member 25 of the position changeover mechanism 20. A holding plate 27 is provided to the feeder tray 18 in such a way that it is swingably supported around a shaft 28 at its upper end and biased upwards by a compression spring 29 for causing the leading edge of the recording sheets 10 piled thereon to be tightly pressed against a feeding roller 30 disposed thereabove.

Figure 7B:
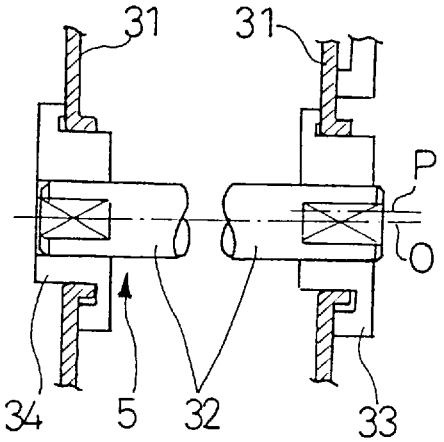

The lower guide 5 which supports the carriage 2 such as to allow it to move freely comprises, as shown in FIG. 3, FIG. 7, and FIG. 8, a guide shaft 32 piercing through and thus letting a guide 2*a* disposed at the lower part of the carriage to slide freely thereon, and eccentric bearings 33, 34 which are fixedly coupled to both ends of the guide shaft 32 such as not to allow the shaft to rotate while being mounted rotatable with respect to a frame 31.

The guide shaft 32 is fixed to the eccentric bearings 33, 34 at a position where the axial center O of the guide shaft 32 is eccentric in relation to the axial center P of the bearings.

Figure 7A:
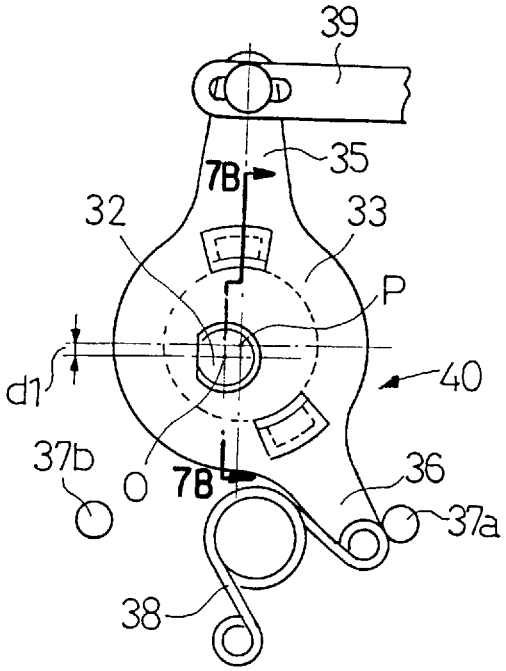
Figure 7C:
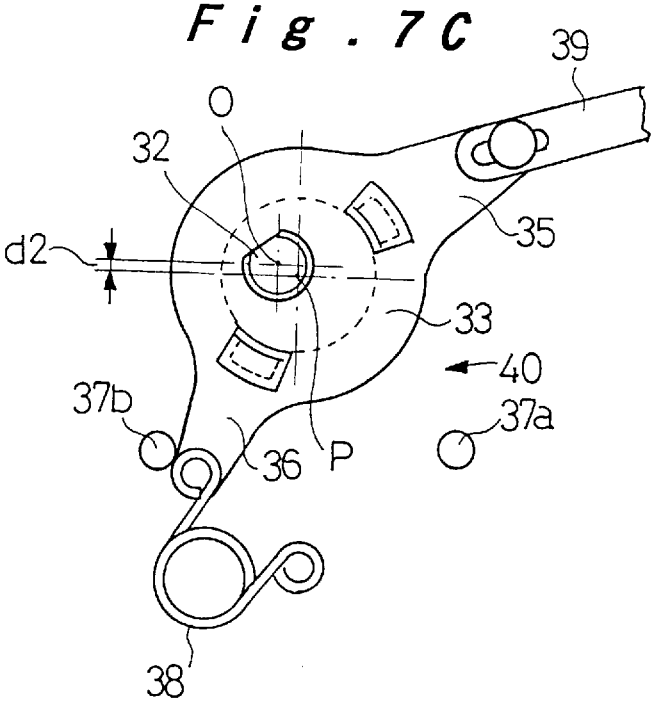

One of the eccentric bearings 33 has a position changeover lever 35 extending upwards and a locator lever 32 extending downwards therefrom. The construction is such that, when the eccentric bearing 33 is at its first rotated position as shown in FIG. 7A, the locator lever 36 couples with a first stopper 37*a,* and when the eccentric bearing 33 is at its second rotated position as shown in FIG. 7C, the locator lever 36 couples with a second stopper 37*b,* and an action spring 38 is connected to the tip of the locator lever 36, so that the eccentric bearing 33 is positioned either at the first or second rotated position. As a whole, these eccentric bearings 33, 34, position changeover lever 35, locator lever 36, first and second stoppers 37*a,* 37*b,* and the action spring 38 constitute a head position changeover mechanism 40.

The tip of the position changeover lever 35 is linked to the rotating member 25 of the position changeover mechanism 20 through a link 39, so that the position changeover lever 35 is pivoted linking with the rotation of the rotating member 25 in order to cause the eccentric bearings 33, 34 to be shifted between the first and second rotated positions.

Thus, when the eccentric bearing 33 and the bearing 34 on the other side linking thereto are at their first rotated position, the axial center O of the guide shaft 32 is located lower in the forward direction than the axial center P of the eccentric bearings 33, 34 by the amount d1 as shown in FIG. 7A, whereas, when the eccentric bearings 33, 34 are at their second rotated position, the axial center O is off to the upper front of the axial center P by the amount d2 as shown in FIG. 7C. As a result, the axial center O of the guide shaft 32 is moved upwards by the amount d=d1+d2 by the rotation of the eccentric bearings 33, 34 from the first rotated position to the second rotated position.

Figure 8B:
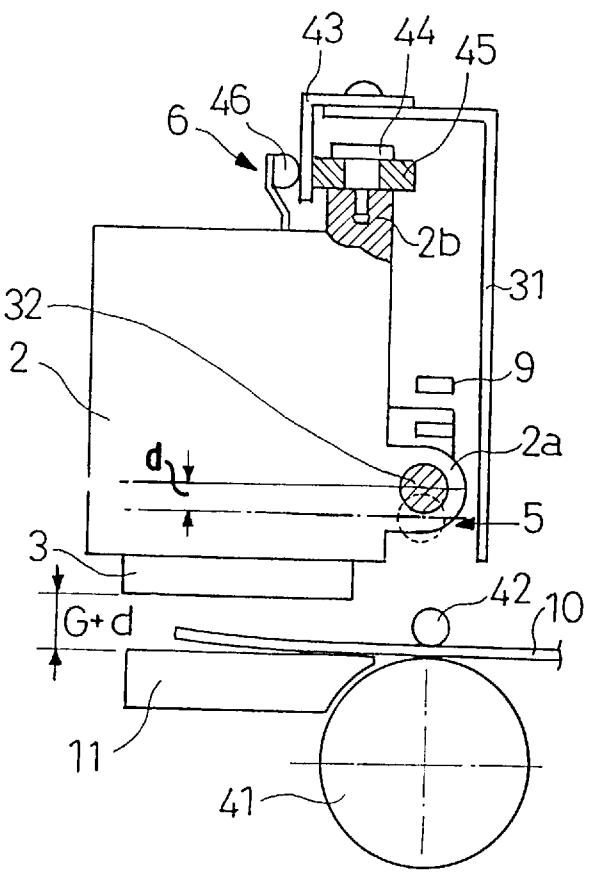
FIGS. 8A and 8B are front views showing the print head and the platen in the embodiment, respectively showing the states located at the first and second positions.
Figure 8A:
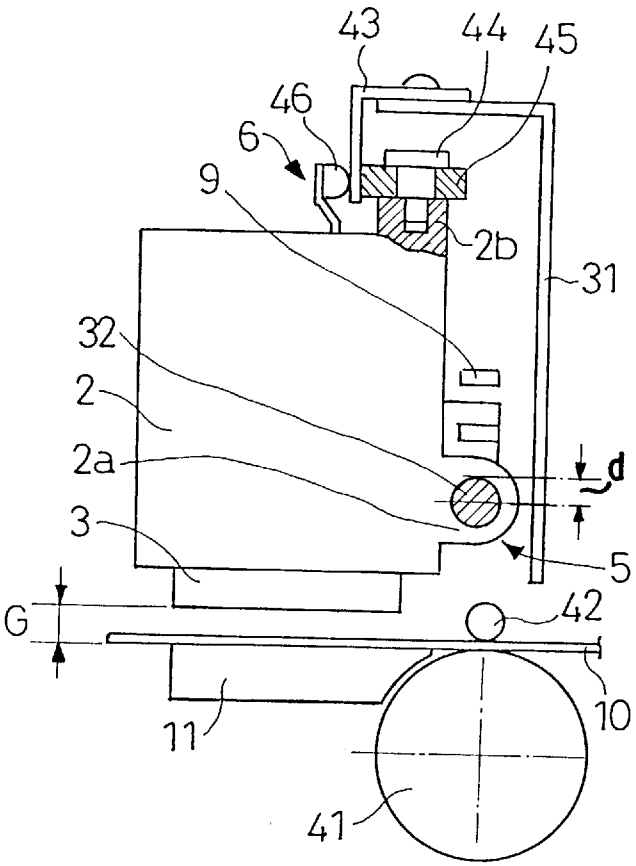
Figure 9A:
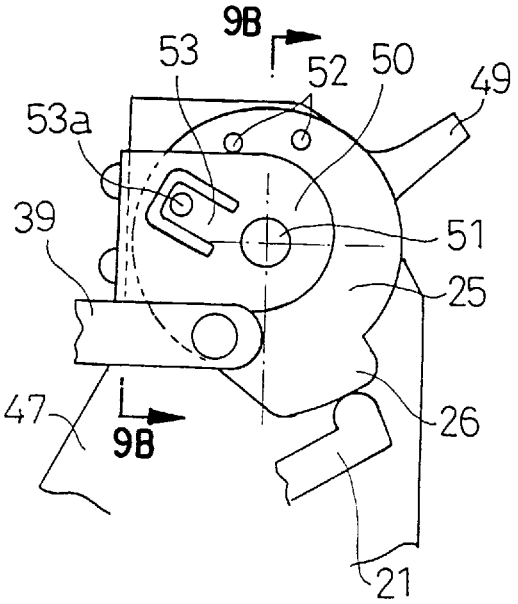
FIG. 9A is a front view and FIG. 9B is a cross sectional view taken along the line B—B of FIG. 9A, both showing a position changeover mechanism in the embodiment.
Figure 9B:
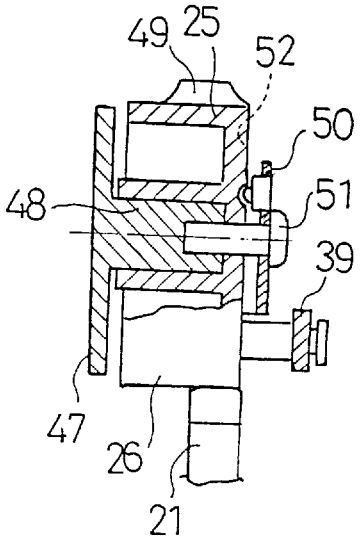
Figure 10A:
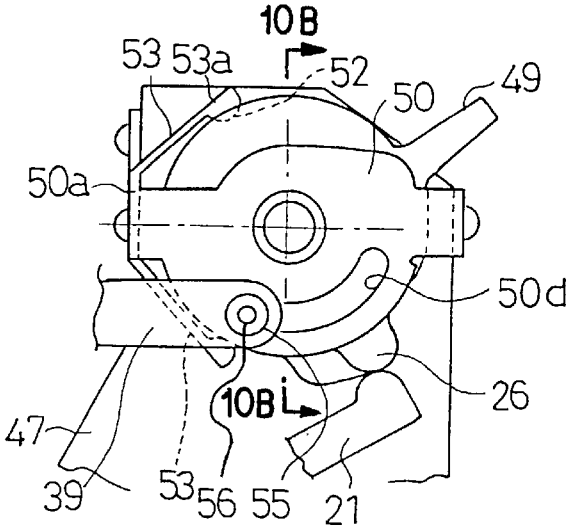
FIG. 10A is a front view.
Figure 10D:
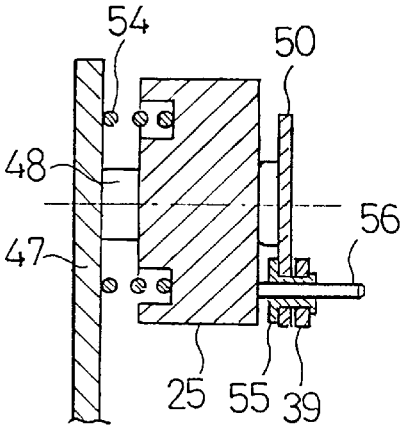
FIG. 10D is a cross sectional view taken along the line C—C of FIG. 10A, all showing a position changeover mechanism in an image recording device according to a second embodiment of the present invention.
Figure 10B:
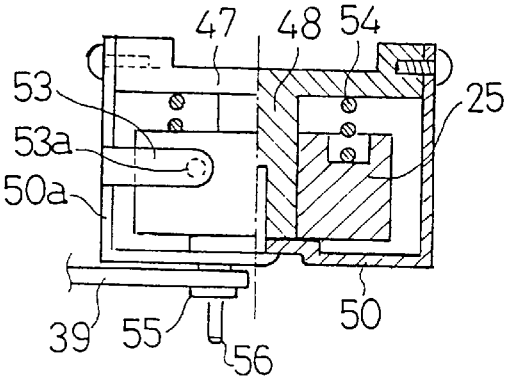
FIG. 10B is a half-cross sectional plan view.
Figure 10C:
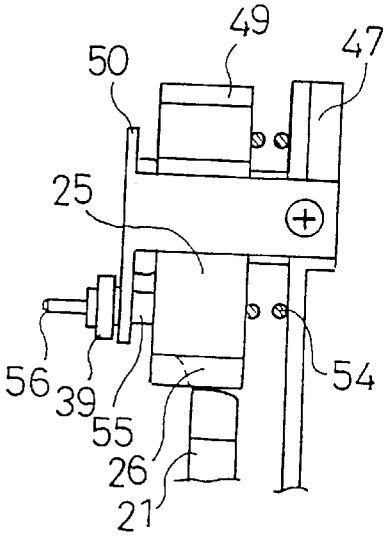
FIG. 10C is a side elevation view.

The carriage 2 can be thus switched over between its upper and lower positions as shown in FIGS. 8A and 8B by changing the position of the guide shaft 32 in the vertical direction by the amount d as described above. More specifically, the carriage 2 is switched over between the state where the distance between the print head 3 and the platen 11 is defined as G as shown in FIG. 8A and the state where the distance between the print head 3 and the platen 11 is defined as G+d as shown in FIG. 8B.

In FIGS. 8A and 8B, reference numerals 41 and 42 respectively represent a timing roller which controls feeding of the recording sheet 10, and a driven roller which holds the 15 recording sheet 10 between itself and the timing roller 41. The upper guide 6 comprises a guide rail 43 mounted to the frame 31 and configured to be an inverted L in cross section, a coupling roller 45 rotatably mounted around a shaft 44 to the boss 2*b* which is projected on the upper end of the carriage 2 so that the coupling roller 45 rotatably contacts to the back side of the guide rail 43, and a pressed sliding member 46 biased toward the front face of the guide rail 45 tightly. The carriage 2 is fixed to the timing belt 9 at a given appropriate location, and driven to move by the rotation of the timing belt 9 by means of the drive motor 7.

The rotating member 25 of the position changeover mechanism 20 is jointed to and rotatably supported around a shaft 48 which is projected to the outer side of a frame 47 of the sheet feeder 17, and is provided with a rotation operative piece 49 on the periphery thereof. Fixed at the front edge of the frame 47 is the base portion of an L-shaped hold plate 50 and disposed in such a way that it crosses the front part of the rotating member 25 and covers the outer side face of the same. The tip of the hold plate 50 is supported with a screw 51 pierced through the hold plate 50 and the rotating member 25 into the shaft 48 and fixed thereto. The hold plate 50 is provided with click spring sections 53 having at their tips click balls 53*a* which are resiliently received in three concaves 53 formed at an equal distance on a circle concentric with the rotation center of the rotating member 25 on its outer side face, so that the rotating member 25 can be located at three different positions shown in FIG. 3, FIG. 4, and FIG. 5.

Next, setting of the separating pawl 21 at its effecting position and non-effecting position in accordance with properties of the recording sheet 10 and setting actions of the distance between the print head 3 and the platen 11 with the constructions described above will be explained mainly with reference to FIGS. 3 to 5. There will be the following three setting modes.

Setting mode No. 1

Recording Sheet: Special Paper or Ordinary Paper

Separating pawl: Effecting Position

Distance: 0.8mm

Setting mode No. 2

Recording Sheet: Curled Paper or OHP Sheet

Separating pawl: Effecting Position

Distance: 1.8mm

Setting mode No. 3

Recording Sheet: Envelope or Postcard

Separating pawl: Non-Effecting Position

Distance: 1.8mm

In other words, in the case of recording sheet of thin or less resilient type, the separating pawl 21 needs to be in its effecting position so as to positively feed the sheet one by one, whereas in the case of recording sheet of thick or resilient type, the separating pawl 21 needs to be in its non-effecting position so as to prevent the recording sheet from being caught by the separating pawl. The distance between the print head 3 and the platen 11 is set to be an optimal value (specifically 0.8mm) in the case of special paper or ordinary paper, whereas in the case of curled sheets or envelops, the distance is widened (specifically 1.8mm) so as to avoid interference between the print head 3 and the recording sheets.

There is another possible combination of the position of the separating pawl 21 and the setting of distance (hereinafter referred to as Setting Mode No. 4), i.e., the pawl being at its non-effecting position and the distance being 0.8mm. This setting mode is not included in this embodiment, as there exist virtually no recording sheet 10 of properties such would require the application of this 4th setting mode except very special cases.

In the setting mode No. 1, the rotating member 25 in the position changeover mechanism 20 is located at a first rotated position as shown in FIG. 3. In this state, the cam 26 is contacted with the coupling boss 24 of the separating pawl 21 to cause the pawl 21 to locate at its effecting position, and the eccentric bearing 33 is located at the first rotated position. The distance between the print head 3 and the platen 11 is thus set to be G (=0.8mm).

In the setting mode No. 2, the rotating member 25 in the position changeover mechanism 20 is located at a second rotated position as shown in FIG. 4. In this state, the coupling boss 24 of the separating pawl 21 is still maintained to be in contact with the cam 26 to cause the pawl 21 to locate at its effecting position. Meanwhile, the eccentric cam 33 is rotated by a tension force of the position changeover lever 35 pulled by the rotating movement of the rotating member 25 from its first position to the second position via the link 39, and eventually located at the second rotated position by the function of the action spring 38. The distance between the print head 3 and the platen 11 is thus set to be G+d (=1.8mm).

In the setting mode No. 3, the rotating member 25 in the position changeover mechanism 20 is located at a third rotated position as shown in FIG. 5. In this state, the coupling boss 24 of the separating pawl 21 departs from the cam 26 and is pulled by the tension spring 23 to cause the pawl 21 to locate at its non-effecting position. Meanwhile, the eccentric bearing 33 is maintained at its second rotated position, as the connecting point between the rotating member 25 and the link 39 slides within a slit 39*a* formed in the link 39 with the rotating movement of the rotating member 25. The distance between the print head 3 and the platen 11 is thus set to be G+d (=1.8mm).

As set forth above, the setting of the separating pawl 21 either at its effecting or non-effecting position and the setting of the distance between the print head 3 and the platen 11 can be effected by rotating the rotating member 25 of the position changeover mechanism 20 by means of the rotation operative piece 49 to select the setting modes No. 1 to 3 according to properties of the recording sheet 10.

Next, a second embodiment of the present invention will be described referring to FIGS. 10 to 13. The construction of the head position changeover mechanism 40 for changing the position of the separating pawl 21 and the height of the print head 3 in this embodiment is substantially identical to the one described in the first embodiment, and thus the only difference, that is the arrangement of the position changeover mechanism 20, will be explained.

In FIGS. 10A–10D, the rotating member 25 is jointed to the shaft 48 in such a way that it can move between the first and second rotated positions along the circumferential direction as well as move between the first and second positions along the axial direction. A spring 54 for biasing the rotating member 25 toward the first position is provided between the rotating member 25 and the frame 47. The hold plate 50 is U-shaped when viewed from the top, and its both ends are fixed to the frame 47. An arcuate slit 50*d* is formed in the hold plate 50 through which the connecting point of the rotating member 25 and the link 39 is pierced.

The link 39 is connected to a sliding member 55 mounted movably along the slit 50*d*. A linking shaft 56 projected from the rotating member 25 is passed through the sliding member 55 such as to allow the shaft 56 to slide along the axial direction, so that the rotation of the rotating member 25 can be transmitted to the link 39 even when the rotating member 25 is moved along the axial direction.

Figure 11A:
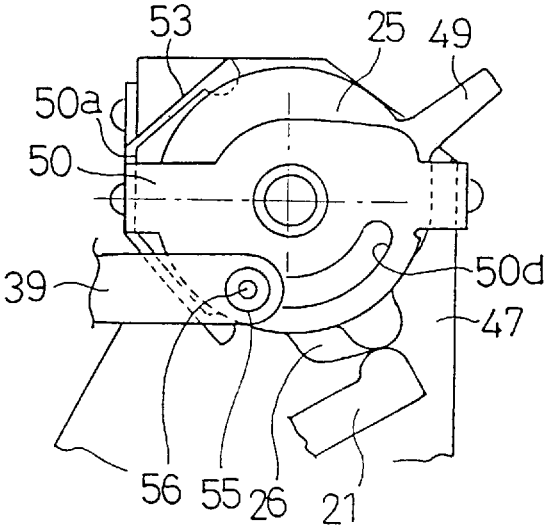
FIG. 11A is a front view and FIG. 11B is a side elevation view, both showing a state located at a first position in the embodiment.
Figure 11B:
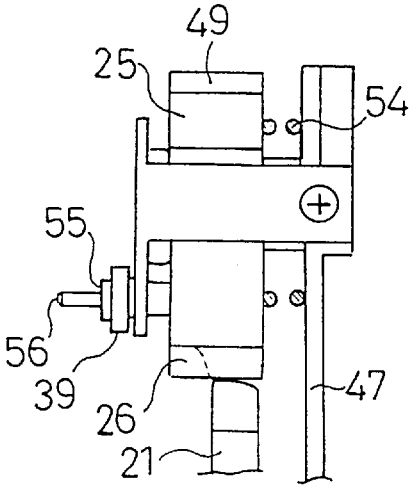
Figure 12A:
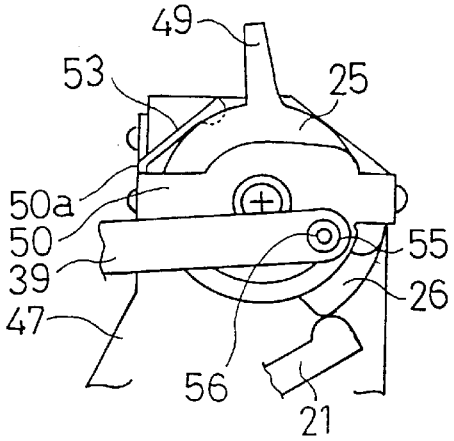
FIG. 12A is a front view.
Figure 12B:
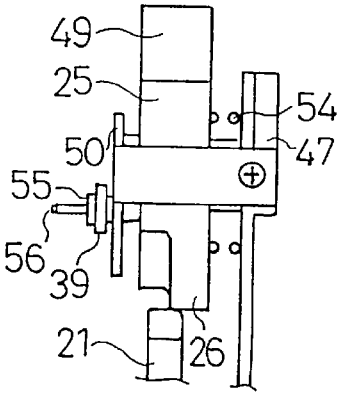
FIG. 12B is a side elevation view.
Figure 12C:
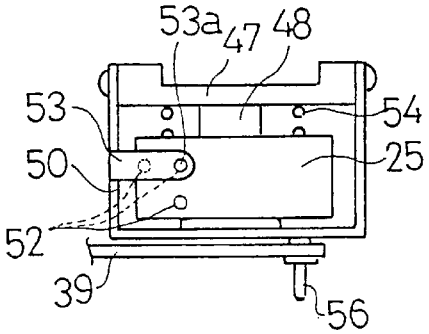
FIG. 12C is a plan view, all showing a state located at a second position in the embodiment.
Figure 13A:
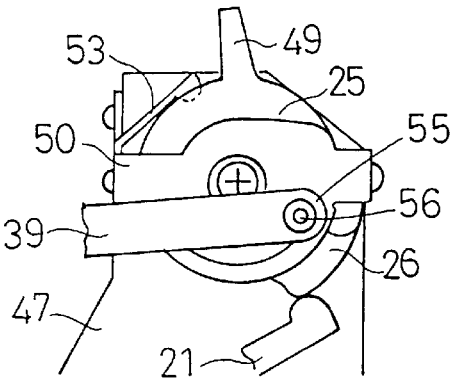
FIG. 13A is a front view and FIG. 13B is a side elevation view, both showing a state located at a third position in the embodiment.
Figure 13B:
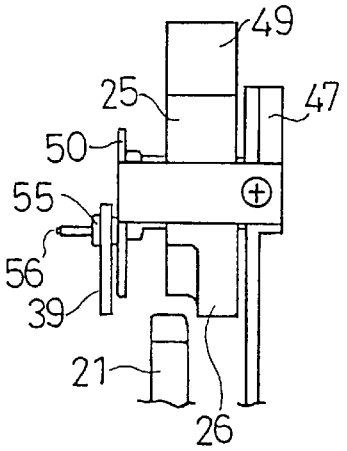

A pair of clip springs 53 are extended upward and downward such that they are pressed tightly to the outer circumferential surface of the rotating member 25 from a connecting plate 50*a* at the front side of the holder plate 50. Correspondingly, three pairs of coupling recesses 52 which respectively receive the pair of click balls 53*a* at the end of each clip spring 53 are formed on the outer circumferential surface of the rotating member 25, so that the rotating member 25 can be fixed in a first positioned state located at a first position in the axial direction as well as at the first rotated position as shown in FIGS. 10 and 11, in a second positioned state located at the same first position in the axial direction as well as at the second rotated position as shown in FIG. 12, and in a third positioned state located at the second position in the axial direction as well as at the second rotated position as shown in FIG. 13. The cam 26 provided on the outer circumference of the rotating member 25 is formed such that it engages with the coupling boss 24 of the separating pawl 21 in the first and second positioned states, and disengages therefrom in the third positioned state.

In the above described arrangement, when the setting mode No. 1 is selected, the rotating member 25 is set in the first positioned state as shown in FIG. 11 so as to cause the separating pawl 21 to locate at the effecting position as shown in FIG. 3 and the eccentric bearing 33 to locate at the first rotated position, and the distance between the print head 3 and the platen 11 is set to be G (=0.8mm).

When the setting mode No. 2 is selected, the rotating member 25 is set in the second positioned state as shown in FIG. 12 so as to cause the separating pawl 21 to remain at the effecting position and the eccentric bearing 33 to locate at the second rotated position as shown in FIG. 4, and the distance between the print head 3 and the platen 11 is set to be G+d (=1.8mm).

When the setting mode No. 3 is selected, the rotating member 25 is set in the third positioned state as shown in FIG. 13 so as to cause the separating pawl 21 to move to the non-effecting position and the eccentric bearing 33 to remain at the second rotated position as shown in FIG. 5, and the distance between the print head 3 and the platen 11 is set to be G+d (=1.8mm).

Next, a third embodiment of the present invention will be described with reference to FIG. 14. Like the second embodiment described above, this embodiment differs from the first embodiment only in the arrangement of the position changeover mechanism 20 which will thus be hereinafter explained.

In FIG. 14, the rotating member 25 is supported in such a way that it can move between the first and second rotated positions along the circumferential direction as well as move between the first and second positions along the axial direction. A spring 54 for biasing the rotating member 25 toward the first position is provided between the rotating member 25 and the frame 47. The hold plate 50 is U-shaped when viewed from the top, either end of which is fixed to the frame 47, and also provided with an upper plate 50*b*. A pair of cuts 50*c* into which the rotation operative piece 49 is received when operating the piece 49 to rotate the rotating member 25 from the first rotated position to the second rotated position in a state where the rotating member 25 is located at the first or second position along the axial direction. An arcuate slit 50*d* is formed in the hold plate 50 through which the connecting point of the rotating member 25 and the link 39 is pierced. The link 39 is connected to a sliding member 55 mounted movably along the slit 50*d*. A linking shaft 56 projected from the rotating member 25 is passed through the sliding member 55 such as to allow the shaft 56 to slide along the axial direction, so that the rotation of the rotating member 25 can be transmitted to the link 39 even when the rotating member 25 is moved along the axial direction.

A pair of clip springs 53 are extended upward and downward such that they are pressed tightly to the outer circumferential surface of the rotating member 25 from a connecting plate 50*a* at the front side of the holder plate 50. Correspondingly, four pairs of coupling recesses 52 which respectively receive the pair of click balls 53*a* at the end of each clip spring 53 are formed on the outer circumferential surface of the rotating member 25, so that the rotating member 25 can be fixed in a first positioned state located at a first position in the axial direction as well as at the first rotated position as shown in FIGS. 14A–14C, in a second positioned state, moved from the first positioned state by rotating the rotating member as shown by the arrow in FIG. 14A, located at the same first position in the axial direction as well as at the second rotated position, in a fourth positioned state, moved from the first positioned state by moving the rotating member in the axial direction as shown by the arrow in FIG. 14C, located at the first rotated position as well as at the second position along the axial direction as shown in FIGS. 14A and 14B, and in a third positioned state, moved from the fourth positioned state by rotating the rotating member as shown by the arrow in FIG. 14A, located at the second position in the axial direction as well as at the second rotated position. The cam 26 provided on the outer circumference of the rotating member 25 is formed such that it engages with the coupling boss 24 of the separating pawl 21 in the first and second positioned states, and disengages therefrom in the third and fourth positioned states.

In this embodiment, the setting of the setting mode No. 1 is effected in the first positioned state, the setting mode No. 2 in the second positioned state, the setting mode No. 3 in the third positioned state, and in the fourth positioned state, since the separating pawl 21 is brought to its non-effecting position as well as the eccentric bearing 33 is located at the first rotated position so as to define the distance between the print head 3 and the platen 11 to be G (=0.8mm), the setting of the setting mode No. 4 is thereby effected. Accordingly, this embodiment enables the selective use of the four setting modes.

Figure 15A:
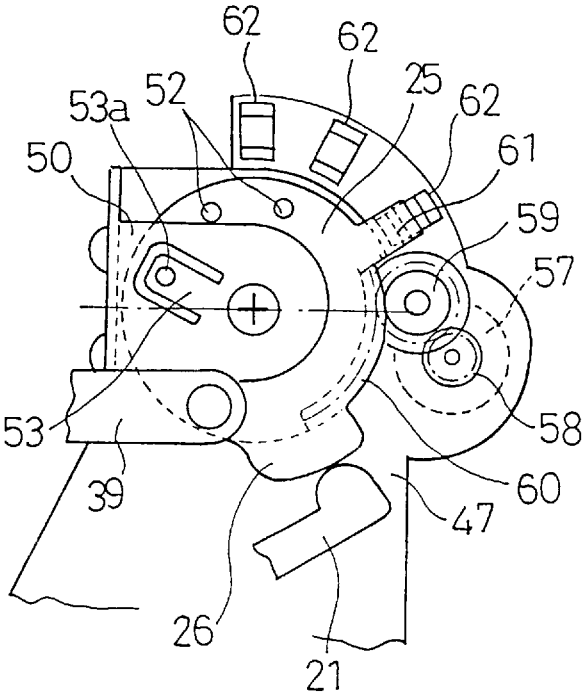
FIG. 15A is a front view and FIG. 15B is a half-cross sectional side elevation view, both showing a position changeover mechanism in an image recording device according to a fourth embodiment of the present invention.
Figure 15B:
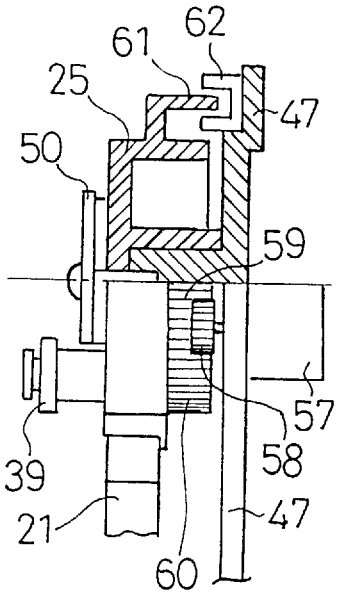

Next, a fourth embodiment of the present invention will be described with reference to FIG. 15. As this embodiment also differs from the first embodiment only in the arrangement of the position changeover mechanism 20, which will thus be explained.

In this embodiment, the rotating member 25 of the position changeover mechanism 20 is driven to rotate by a drive motor 57. A drive pinion 58 is fixed to the output shaft of the motor 57 and linked to a partially-toothed wheel 60 formed on the outer circumferential surface of the rotating member 25 via a reduction gear 59 which is rotatably supported on the frame 47. The position changeover mechanism 20 is further constructed such that the drive motor 57 is stopped when a detection piece 61 projected on the outer circumferential surface of the rotating member 25 is detected by one of three position detectors 62 disposed corresponding to the first to third rotated positions of the rotating member 25. The drive motor 57 is controlled by a controlling unit when any of the setting modes No. 1–3 is selected in accordance with properties of the recording sheet 10. The positioning of the rotating member 25 at each setting position is effected by means of the click springs 53 with the click balls 53*a* being received in the coupling recesses 52 as in the first embodiment.

In this embodiment, in addition to the similar effects of the first embodiment, each setting mode is automatically set by the drive motor 57 by inputting a desired setting mode in the controlling unit.

As set forth above, according to the image recording device of the present invention, by means of a pawl changeover mechanism for shifting the position of the separating pawl, a head position changeover mechanism for changing the distance between the print head and the platen, a position changeover mechanism which can be set at several different positions, and a linking mechanism for setting both of the pawl changeover mechanism and the head position changeover mechanism at a prescribed position in accordance with the position of the position changeover mechanism, the pawl position changeover mechanism and the head position changeover mechanism can be set at an appropriate position for the recording sheet by setting the position changeover mechanism at the desired position corresponding to types of the recording sheet. Accordingly, with a simple switchover operation at one point, both of the separating pawl and the print head can be set at a proper position in accordance with types of the recording sheet, thereby preventing errors in sheet feeding or recording which might be caused by forgetting to switch over one of operational levers in case that changeover must be made at more than one points.

Next, the sheet feeding mechanism of the present invention is described referring to FIGS. 16 to 19.

Figure 16:
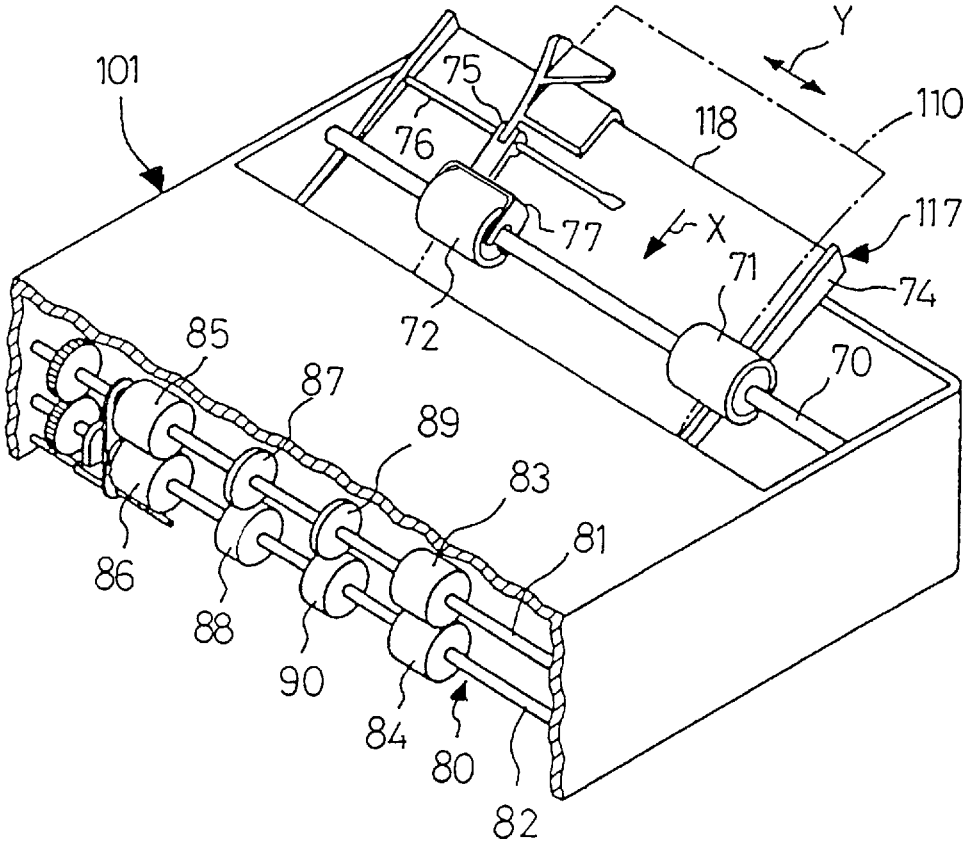
FIG. 16 is a partial perspective view of a printer in which a sheet feeding mechanism of the present invention is incorporated.
Figure 17:
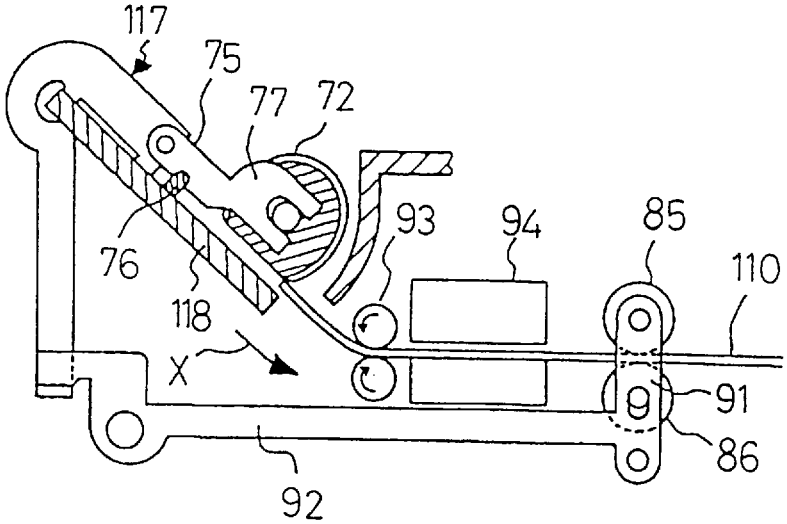
FIG. 17 is a longitudinal cross sectional view of the sheet feeding mechanism of the present invention.

In a printer 101 having a sheet feeding section 117 shown in FIGS. 16 and 17, a sheet feeding shaft 70 is provided along a direction (widthwise direction Y) orthogonal to the sheet feeding/discharging direction X, which is connected to and driven by a motor (not shown). The feeding shaft 70 is provided with a first feeding roller 71 and a second feeding roller 72 made of a resilient material such as rubber and configured to be substantially semicircular. The first feeding roller 71 is fixed to the feeding shaft 70, while the second feeding roller 72 is rotated with the shaft 70 as well as capable of moving along the axial direction by means of a guide provided to the feeding shaft 70 and a guided section formed on the second feeding roller 72 (both not shown).

Figure 19:
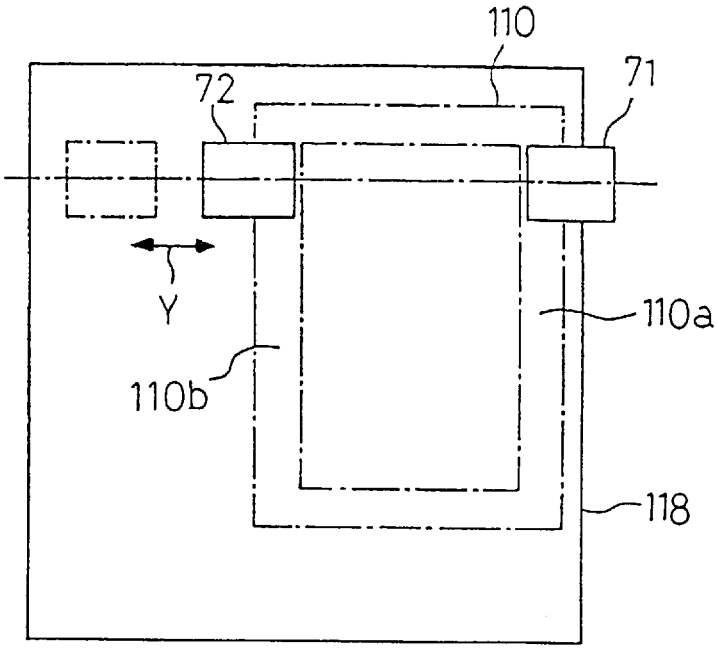
FIG. 19 is a plan view showing a state in which rollers are in contact with a non-image-forming area of a sheet.

Below the feeding rollers 71, 72 is a table 118 on which sheets 110 to be fed are loaded. A fixed guide (sheet width guide) 74 is formed at one end of the table 118 for restricting one end of the sheets 110. A cut portion (not shown) is provided in the fixed guide 74 so as to allow the first feeding roller 71 to contact to a non-image-forming area 110*a* at one end of the sheet 110 as shown in FIG. 19.

Figure 18:
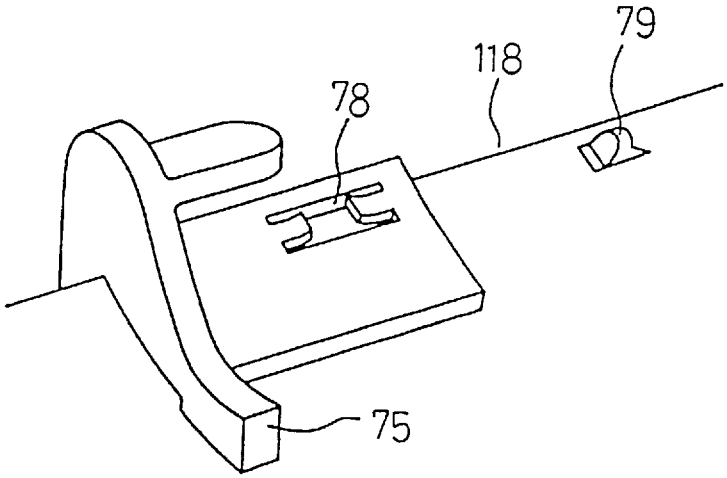
FIG. 18 is a perspective view of a movable guide in a sheet feeding section.

At the other side of the table 118 is a movable guide (sheet width guide) 75 which restricts the other end of the sheets 110. A guide rib 76 is extended along the widthwise direction Y for guiding the movable guide 75 to move along the same direction. The movable guide 75 further has a U-shaped arm 77 contacting to both ends of the second feeding roller 72, so that the second feeding roller 72 can be adjusted at a given position by moving the movable guide 75 along the guide rib 76. Also, the movable guide 75 and the table 118 respectively have cuts 78 and a plurality of locator bosses 79 as shown in FIG. 18 (although there is shown only one of them in the figure), which can couple with the cuts 78, so that, when the sheets 110 of predetermined size such as A4 or B5 are set on the table 118 and one end of the sheets 110 is restricted by the fixed guide 74, the movable guide 75 can accurately restrict the other end of the sheets 110 as well as allow the second feeding roller 72 to contact to a non-image-forming area 110*b* at the other end of the sheet 110 as shown in FIG. 19.

In a sheet discharging section 80 of the printer 101, a pair of discharging shafts 81, 82 extending along the widthwise direction are mounted at upper and lower sides, and connected and driven by a motor (not shown). A first upper discharging roller 83, a second upper discharging roller 85, and two star wheels 87, 89 disposed at a substantially equal distance between the two discharging rollers 83, 85 are mounted to the upper discharging shaft 81. Although the star wheels 87, 89 are illustrated by circles in the figure, they are actually configured in the form of a star shape or a toothed wheel. The first upper discharging roller 83 and the star wheels 87, 89 are fixed to the discharging shaft 81, while the second upper discharging roller 85 is rotated with the discharging shaft 81 as well as arranged movable along the axial direction by a similar construction as that of the second feeding roller 72. Also, the first upper discharging roller 83 is disposed on the same line as the first feeding roller 71 along the sheet discharging direction X, and thus contacted to the non-image-forming area at one end of the sheet 110 being discharged.

Similarly, a first lower discharging roller 84, a second lower discharging roller 86, and two rollers 88, 90 disposed at a substantially equal distance between the two rollers are provided to the lower discharging shaft 82. The first lower discharging roller 84 and the rollers 88, 90 are fixed to the discharging shaft 82, while the second lower discharging roller 86 is rotated with the discharging shaft 82 as well as arranged movable along the axial direction by a similar construction as that of the second feeding roller 72. Also, as shown, the first lower discharging roller 84, the second lower discharging roller 86, and the rollers 88, 89 are respectively pressed tightly against the first upper discharging roller 83, the second upper discharging roller 85, and the star wheels 87, 89.

The second upper discharging roller 85 and the second lower discharging roller 86 are connected by a linking member 91 so as to be movable integrally along the widthwise direction Y. The linking member 91 is connected to the movable guide 75 in the sheet feeding section 117 by a link 92 mounted at the lower side of the sheet feeding section 117 as shown in FIG. 17, so as to cause the second upper discharging roller 85 and the second lower discharging roller 86 to move in the same direction at the same time by shifting the movable guide 75 along the widthwise direction Y.

Between the sheet feeding section 117 and the sheet discharging section 80 are a sheet transferring mechanism such as a transferring roller 93 or the like and an inkjet head 94 for printing an image onto the sheet 110 being transferred.

When forming images in the printer 101 constructed as described above, the sheets 110 are first placed on the table 118 in the sheet feeding section 117. One end of the sheets 110 is aligned along the fixed guide 74. The movable guide 75 is then shifted along the widthwise direction Y for guiding the other end of the sheet 110. In this state, the first feeding roller 71 is contacting with the non-image-forming area 110*a* at one side of the sheet 110 and the second feeding roller 72 is contacting with the other non-image-forming area 110*b* at the other side of the sheet 110 as shown in FIG. 19.

When the movable guide 75 is shifted, the second upper discharging roller 85 and the second lower discharging roller 86 in the sheet discharging section 80 are moved with the second feeding roller 72, so that they can contact with the non-image-forming area 110*b* at the other end of the sheet 110 being discharged to the sheet discharging section 80. Meanwhile, the first upper discharging roller 83 and the first lower discharging roller 84 are fixed on the same line as the first feeding roller 71, thus being contacted to the non-image-forming area 110*a* at one side of the sheet 110 being discharged to the sheet discharging section 80.

When the feeding shaft 70 is rotated in this state, the sheet 110 is supplied from the sheet feeding section 117 by the rotation of the first and second feeding rollers 71, 72. The sheet 110 is transferred by the transferring roller 93, and an image is formed on its upper face with the inkjet head 94. Meanwhile, the discharging shafts 81, 82 are also rotated, and the sheet 110 on which the image has been formed is held from the upper and lower sides and discharged. Although the star wheels 87, 89 are also brought into contact with the printed face of the sheet 110, they are contacted to the image only lightly and in a limited minute portion, and thus do not damage the quality of the image.

As set forth above, the printer 101 having the sheet feeding mechanism of the present invention is capable of feeding and discharging the sheet without pressing the rollers tightly against the image-forming area of the sheet. Accordingly, images of high quality can be formed on special paper having a coated layer on the image forming surface which are exclusively used in an inkjet printer. Also, a sufficient transferring force as well as a tension along the transferring direction can be applied to the sheet 110 in the sheet discharging section 80. The sheets can be thus maintained in a prescribed sheet transferring path, and a printable area along the sheet feeding/discharging direction can be widely secured, which is advantageous especially in the inkjet printer.

Although the present invention has been described with reference to the embodiments applied to the printer, the present invention can also be applied to any other image forming devices such as a copier or facsimile machine, as long as the device has such a construction as to transfer sheets from the sheet feeding section to the sheet discharging section.

The material fed by the sheet feeder is not limited to paper, and the sheet feeder according to the present invention can be also applied to the feeding and discharging of a resin film such as an OHP film.

Further, although the feeding roller in the sheet feeding section and the discharging roller in the sheet discharging section are connected by a link in the embodiment described above, any other linking mechanism can be employed, as long as the both members are mechanically connected such that, by moving one of the rollers, the other roller can be moved at the same time.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image recording device comprising:

a sheet feeding mechanism for supplying recording sheets, having a separating pawl for separating the recording sheets which is movable between an effecting position and non-effecting position;

a platen for guiding the recording sheets supplied by the sheet feeding mechanism;

a print head disposed opposite to the platen for recording an image onto the recording sheets guided by the platen, the print head and the platen being spaced such as to have a first distance and a second distance being different from the first distance that can be changed over to one another; and a linking mechanism for causing an action of changing over positions of the separating pawl to link with an action of changing over the distance between the print head and the platen.

2. An image recording device according to claim 1, further comprising an operative member, wherein the linking mechanism effects both actions of changing over positions of the separating pawl and changing over the distance between the print head and the platen such as to be linked to each other by operating said operative member.

3. An image recording device according to claim 2, wherein the operative member can be located at a first, second, and third positions;

the linking mechanism causes the separating pawl to locate at the effecting position and the distance between the print head and the platen to be the first distance when the operative member is located at the first position;

the linking mechanism causes the separating pawl to locate at the effecting position and the distance to be the second distance when the operative member is located at the second position; and the linking mechanism causes the separating pawl to locate at the non-effecting position and the distance to be the second distance when the operative member is located at the third position, said first distance being smaller than the second distance.

4. An image recording device according to claim 3, wherein the operative member can be further located at a fourth position; and the linking mechanism causes the separating pawl to locate at the non-effecting position and the distance between the print head and the platen to be the first distance when the operative member is located at the fourth position.

5. An image recording device according to claim 2, wherein the linking mechanism is connected to the platen so that the distance between the platen and the print head can be changed over by moving the platen in relation to the print head.

6. An image recording device according to claim 5, wherein the linking member is further connected to the print head so that the distance between the platen and the print head can be changed over by moving not only the platen but also the print head.

7. An image recording device according to claim 2, wherein the operative member is a rotating member with a lever.

8. An image recording device according to claim 7, wherein the rotating member can rotate around its rotation axis as well as move in a direction along the rotation axis.

* * * * *